US010966507B2

(12) United States Patent
Schoonover

(10) Patent No.: US 10,966,507 B2
(45) Date of Patent: Apr. 6, 2021

(54) REMOVAL AND RE-APPLICATION BOARD FOR HAIR EXTENSIONS AND PROCESS

(71) Applicant: International Designs Corporation, LLC, Hallandale Beach, FL (US)

(72) Inventor: Richard Schoonover, Hallandale Beach, FL (US)

(73) Assignee: INTERNATIONAL DESIGNS CORPORATION, LLC, Hallandale Beach, FL (US)

( * ) Notice: Subject to any disclaimer, the term of this patent is extended or adjusted under 35 U.S.C. 154(b) by 0 days.

(21) Appl. No.: 16/929,855

(22) Filed: Jul. 15, 2020

(65) Prior Publication Data

US 2020/0345123 A1 Nov. 5, 2020

Related U.S. Application Data

(62) Division of application No. 15/726,796, filed on Oct. 6, 2017, now Pat. No. 10,729,222.

(51) Int. Cl.
*A45D 44/02* (2006.01)
*A41G 5/00* (2006.01)

(52) U.S. Cl.
CPC ..... *A45D 44/02* (2013.01); *A41G 5/004* (2013.01)

(58) Field of Classification Search
CPC ..... A41G 5/00; A41G 5/0013; A41G 5/004; A41G 5/0086; A41G 5/0073; A45D 2007/005; A45D 44/02; A45D 44/04; A45D 44/14; A45D 8/00; A45D 2008/002; A45D 83/34
USPC .... 211/13.1, 60.1; 132/105, 212, 53, 54, 56; 223/120, 66; 434/94, 377, 270
See application file for complete search history.

(56) References Cited

U.S. PATENT DOCUMENTS

| | | | |
|---|---|---|---|
| 4,541,677 | A | 9/1985 | Logan et al. |
| 4,583,562 | A | 4/1986 | Stewart |
| 4,810,196 | A | 3/1989 | Walker |
| 5,252,074 | A | 10/1993 | Passage et al. |
| 5,413,124 | A | 5/1995 | Incando |

(Continued)

OTHER PUBLICATIONS

"How to Remove Tape in Extensions" by Glam Seamless at glamseamless.com.com/blogs, Jul. 20, 2015.

(Continued)

*Primary Examiner* — Jennifer E. Novosad
(74) *Attorney, Agent, or Firm* — Robert C. Kain

(57) ABSTRACT

A removal and re-application board for hair extensions and process of using same. The board contains at least 3 serially spaced apart lines (linear or curvilinear), vertically or radially spaced apart. Hair extension bands are mounted on, above or below the lines. Board indicia conveys sequential band removal and board placement, and then band board-dismount and re-application sequential order data to re-apply the hair bands on a user's head. When the bands are on-board, the bands from a columnar matrix; therefore the serially spaced apart lines provide board-mounting and board dismounting data to the stylist (board-mounting is hair band removal; board dismounting is band re-application). The indicia and the serially spaced apart lines allow for hair bands to be easily stored (board-mounted) and organized, such that the hair bands can be reliably re-applied to substantially the same location on a user's head.

5 Claims, 8 Drawing Sheets

(56) References Cited

U.S. PATENT DOCUMENTS

| | | | | |
|---|---|---|---|---|
| 6,719,565 | B1 | 4/2004 | Saita et al. | |
| 7,758,347 | B2 | 7/2010 | Sasaki | |
| 9,310,533 | B2 | 4/2016 | Angelini | |
| D782,739 | S | 3/2017 | Crocilla | |
| 10,729,222 | B2 * | 8/2020 | Schoonover | A45D 44/02 |
| 2003/0175663 | A1 | 9/2003 | Fuchs | |
| 2005/0227206 | A1 | 10/2005 | Hirata et al. | |
| 2009/0235948 | A1 | 9/2009 | Zephyr et al. | |
| 2016/0316894 | A1 | 11/2016 | Smith et al. | |
| 2017/0055615 | A1 | 3/2017 | Crocilla | |
| 2018/0116324 | A1 | 5/2018 | Harris | |
| 2019/0104828 | A1 | 4/2019 | Schoonover | |
| 2020/0345123 | A1 * | 11/2020 | Schoonover | A45D 44/02 |

OTHER PUBLICATIONS

"Hair Extension Training Guide" by Vision Hair Extensions, visionhairextension.com, May 20, 2011.
"Hair Extension Manual" by Donna Bella Milan at donnabellahair.com, Mar. 25, 2015.

* cited by examiner

Back

FIG. 7A Removal and Board Mount Process A

| | | col-1 | col-2 | col-3 | col-4 | col-5 | col-6 | col-7 |
|---|---|---|---|---|---|---|---|---|
| Nape | Bd row-1 | 22 | 23 | 24 | 25 | 26 | 27 | 28 |
| | Bd row-2 | 15 | 16 | 17 | 18 | 19 | 20 | 21 |
| | Bd row-3 | 8 | 9 | 10 | 11 | 12 | 13 | 14 |
| Crown | Bd row-4 | 1 | 2 | 3 | 4 | 5 | 6 | 7 |

FIG. 7B Removal and Board Mount Process B

| | | col-1 | col-2 | col-3 | col-4 | col-5 | col-6 | col-7 |
|---|---|---|---|---|---|---|---|---|
| Nape | Bd row-1 | 1 | 2 | 3 | 4 | 5 | 6 | 7 |
| | Bd row-2 | 8 | 9 | 10 | 11 | 12 | 13 | 14 |
| | Bd row-3 | 15 | 16 | 17 | 18 | 19 | 20 | 21 |
| Crown | Bd row-4 | 22 | 23 | 24 | 25 | 26 | 27 | 28 |

FIG. 7C Removal and Board Mount Process C

| | | col-1 | col-2 | col-3 | col-4 | col-5 | col-6 | col-7 |
|---|---|---|---|---|---|---|---|---|
| Nape | Bd row-1 | 1 | 5 | 9 | 13 | | | |
| | Bd row-2 | | 2 | 6 | 10 | 14 | | |
| | Bd row-3 | | | 3 | 7 | 11 | 15 | |
| Crown | Bd row-4 | | | | 4 | 8 | 12 | 16 |

FIG. 7D Removal and Board Mount Process D

| | | col-1 | col-2 | col-3 | col-4 | col-5 | col-6 | col-7 |
|---|---|---|---|---|---|---|---|---|
| Nape | Bd row-1 | | | | 4 | 8 | 12 | 16 |
| | Bd row-2 | | | 3 | 7 | 11 | 15 | |
| | Bd row-3 | | 2 | 6 | 10 | 14 | | |
| Crown | Bd row-4 | 1 | 5 | 9 | 13 | | | |

FIG. 7E Removal and Board Mount Process A1 (Left-to-Right)

| | | col-1 | col-2 | col-3 | col-4 | col-5 | col-6 | col-7 |
|---|---|---|---|---|---|---|---|---|
| Nape | Bd row-1 | 28 | 27 | 26 | 25 | 24 | 23 | 22 |
| | Bd row-2 | 21 | 20 | 19 | 18 | 17 | 16 | 15 |
| | Bd row-3 | 14 | 13 | 12 | 11 | 10 | 9 | 8 |
| Crown | Bd row-4 | 7 | 6 | 5 | 4 | 3 | 2 | 1 |

FIG. 7F Removal and Board Mount Process C1(Left-to-Right)

| | col-1 | col-2 | col-3 | col-4 | col-5 | col-6 | col-7 |
|---|---|---|---|---|---|---|---|
| Bd row-1 | | | | 13 | 9 | 5 | 1 |
| Bd row-2 | | | 14 | 10 | 6 | 2 | |
| Bd row-3 | | 15 | 11 | 7 | 3 | | |
| Bd row-4 | 16 | 12 | 8 | 4 | | | |

FIG. 8A

Linear to Radial Conversion (Curvilinear Left-to-Right)

| | | Left Col. | Center Left Col. | Center Right Col. | Right Col. |
|---|---|---|---|---|---|
| Bd row-1 | Inner Arcuate Segment | 13 | 14 | 15 | 16 |
| Bd row-2 | Intermediate In'r Arc Seg | 9 | 10 | 11 | 12 |
| Bd row-3 | Intermediate Out'r Arc Seg | 5 | 6 | 7 | 8 |
| Bd row-4 | Outer Arcuate Segment | 1 | 2 | 3 | 4 |

FIG. 8B

Linear to Radial Conversion (Diagonal Right-to-Left)

| | | Left Col. | Center Left Col. | Center Right Col. | Right Col. |
|---|---|---|---|---|---|
| Bd row-1 | Inner Arcuate Segment | 10 | 8 | 5 | 1 |
| Bd row-2 | Intermediate In'r Arc Seg | 9 | 6 | 2 | |
| Bd row-3 | Intermediate Out'r Arc Seg | 7 | 3 | | |
| Bd row-4 | Outer Arcuate Segment | 4 | | | |

REMOVAL AND RE-APPLICATION BOARD FOR HAIR EXTENSIONS AND PROCESS

This is a divisional patent application based upon and claiming the benefit of patent application Ser. No. 15/726,796, filed Oct. 6, 2017, now pending, the contents of which is incorporated herein by reference thereto.

The present invention relates to a removal and re-application board for hair extensions and the process of removing and re-applying the hair extensions through use of the board.

BACKGROUND OF THE INVENTION

It is increasingly fashionable to wear hair extensions to add length and volume to an individual's existing hair. Hair extensions are lengths of hair attachable to a individual's head to make the individual's hair appear either fuller, longer or add color. There are a variety of types of hair extensions and methods of attaching the hair extensions to the individual's head. For example, hair extensions can be attached by hot fusion or keratin bond, cold fusion or micro-links, tape-in hair extensions, glue-in extensions, sew-in or braided hair extensions, clip-in extensions, and micro-link skin weft. The choice of hair extensions is dependent upon the individual's type of hair, lifestyle, budget and time.

Tape-in extensions are applied using either double or single-sided tape. High quality tape-in hair extensions may remain in the hair for up to 6-8 weeks. The tape-in hair extensions can be removed and reused as many as three times. In order for tape-in hair extensions to blend flawlessly with the individual's hair, the individual needs to have a haircut with the extensions in place. Accordingly, the tape-in extensions are cut to a certain length dependent upon where they are located on the individual's head. If the extension is on the lower part of the head, near the nape of the neck, the extension is likely to be cut shorter than an extension that is placed near the crown or upper part of the user's head. Therefore, it is ideal to re-apply the hair extensions in the same location as they were in the first application when the individual received the hair cut with the installed/applied hair extensions in place on the user's head. However, there is no known method for keep the extensions organized so that they are able to be accurately re-applied in the same location on the head.

Tape-in extensions include a polyurethane adhesive tape with a removable backing. The tape-in extensions are typically applied in pairs with an adhesive side facing each other and the pair is secured to the user's hair by the user's natural hair being sandwiched between the pair. The user's hair is also secured to outer side of the sandwiched extensions when double-sided tape is used. The tape-in extensions are typically applied by starting at the nape of the neck and taking about one and a half inch of the user's hair down. Then, one quarter of the one and half inch part is sectioned off. The backing is removed from a tape-in hair extension and tape-in hair extension is placed under the one quarter section of hair with the adhesive side up. The user's hair is gently rubbed onto the adhesive stip using a comb. Next, a second tape-in extension is placed directly on top of the first, bottom extension. The extensions are then pinched together forming a sandwich around the user's hair. This pattern is repeated as the extensions are added upward to the crown of the head. At the earline, the extensions will be placed all around the head. The number of tape-in extensions used depends upon the user's hair texture, length and desired volume. The extensions can be placed in a serially spaced apart line or in bricklaying fashion, depending upon the desired coverage.

The current invention provides a removal and re-application board for hair extensions which simplifies and organizes extension removal and extension re-application onto the user's head. The inventive removal and re-application board and process overcomes the forgoing disadvantages and issues encountered when trying to remove extensions while maintaining their order so that they are re-applied in nearly the same location on the user's head.

OBJECTS OF THE INVENTION

It is an object of the present invention to provide a removal and re-application board for hair extensions that carries with it the integral means for conveying a message, namely, the board includes indicia that prescribes the order in which to remove and re-apply the hair extensions to a user's head.

It is also an object of the present invention to provide a process for removing, storing and re-applying tape-in hair extensions through the use of a removal and re-application board. The board has several serially spaced apart lines that correspond to horizontal rows of extensions in a user's head. The serially spaced apart lines include indicia that allow for pairs of extensions to be easily stored and organized, such that the hair extension pairs may be reliably re-applied to the same location on a user's head.

SUMMARY OF THE INVENTION

The current invention provides a removal and re-application board for hair extensions which simplifies and organizes removal and re-application. The removal & re-application board has indicia that allows for extensions to be temporarily mounted onto the indicia-carrying board (an on-boarding process) and then to be removed from the board and re-applied in the same location on the user's head as the original hair extension application (off-boarding and re-application). The removal and re-application board easily fits on a stylist tray and the tape-in hair extensions either adhere to the board or are pin-mounted to the indicia-carrying board. The removal and re-application board and process overcomes the forgoing disadvantages and issues encountered when trying to remove extensions while maintaining their order so that they are re-applied in nearly the same location on the user's head.

The present invention provides a removal and re-application board for a plurality of hair extensions, each hair extension having a multitude of long strands of hair attached thereto, and each hair extension first being removed by a stylist from a user's head and subsequently re-applied by said stylist to said user's head. The board has at least 3 but no more than 9 serially spaced apart lines that include identifying indicia. The board has a plurality of indicia representing bottom hair extension location data on or near ones of the serially spaced apart lines. The board also has a plurality of indicia representing top hair extension location data on or near said ones of the serially spaced apart lines. The top hair extension location data is opposite the bottom hair extension location data with respect to a corresponding line.

During a removal and a mounting process, each hair extension is removed from a series of rows of the hair extensions on a user's head beginning with rows near a crown of the user's head and working downward towards a nape of the user's head, a row at a time. Each removed hair extension is mounted onto the board beginning with either (a) a lowermost line on the board and continues filling the board with hair extensions first linearly along the lowermost line and then vertically above the lowermost line to a next vertically spaced apart line on said board, or (b) an outermost line on the board and continues filling the board with hair extensions along the outermost line to a next vertically spaced line on said board towards the centermost line on the board. During a re-application process, the board-mounted hair extensions are withdrawn from the board contrariwise with respect to the mounting process and each hair extension is re-applied to the user's head starting at the nape.

The lines of the removal and re-application board may be serially spaced apart parallel linear lines or curvilinear parallel lines. The removal and re-application board can be rectangular shaped, square shaped, curvilinear, shaped in an arc or half circle or a circle. The removal and re-application board may be shaped in a variety of ways while still maintaining the desired functionality due to the indicia on the board as it relates to the serially spaced apart parallel lines.

The present invention provides a process for removing, storing and re-applying tape-in hair extensions. The steps begin with removing tape-in hair extensions from a user's head beginning at a crown of an individual's head with a first pair of hair extensions. Next separate the first pair of hair extensions from each other and from a user's hair. The top of the first pair of hair extensions are adhered onto a removal and re-application board, wherein the removal and re-application board has at least 3 but no more than 9 serially spaced apart parallel lines and the top of the first pair of extensions is adhered on a space above a serially spaced apart line, the serially spaced apart line being the lowest of the serially spaced apart lines on the board. The bottom from the first pair of hair extensions is adhered onto the removal and re-application board in a space below the serially spaced apart line containing the top of the first pair of hair extensions.

A second pair of hair extensions is removed from the user's head that was adjacent to the first pair of hair extensions and in a same horizontal row on the user's head. The second pair of hair extensions are separated from each other and from the user's hair. The top of the second pair of extensions are adhered onto the removal and re-application board in the space above the serially spaced apart line, adjacent to the top of the first pair. A bottom from the second pair of extensions is adhered onto the removal and re-application board in the space below the serially spaced apart line, adjacent to the bottom of the first pair. The remaining pairs of hair extensions are continued to be removed in the same horizontal row on the user's head and placed sequentially in the serially spaced apart line adjacent the first and second pair of hair extensions. The next row of hair extensions are continued to be removed under the first row proceeding in rows down the head toward the nape of the neck. The hair extensions are adhered to the removal and re-application board on the designated serially spaced apart line proceeding in a direction from the bottom of removal and re-application board to the top of the board.

Another summarization of the invention is a re-application board adapted to removably hold a plurality of hair extensions thereon. Each hair extension has a multitude of long strands of hair attached thereto. Each hair band adapted to be removed from a user's as-presented head by a stylist in an on-boarding process. Subsequently, the hair stylist or the user re-applies the hair bands to the user's head in a re-application process. Prior to the on-boarding process, the as-presented, band-carrying user's head has each band having a head location presented in a series of hair extension band rows from a user's crown to a user's nape. The re-application board includes a board (typically a flat, planar board) with at least 3 serially spaced apart lines on the board. The serially spaced apart lines being either parallel lines or curvilinear lines and forming a columnar matrix of serially spaced apart lines. The columnar matrix mapping the hair extensions presented on the user's as-presented head prior to the on-boarding process. A plurality of band location indicia is marked on the board adjacent respective serially spaced apart lines. In this manner, during the on-boarding process, each band is adapted to be removed from the user's head in a predetermined sequential manner. Then each band is sequentially mounted on the board forming board-mounted bands. The band location indicia maps removed bands from the user's head. During the re-application process, the board-mounted bands are removed from the board in a contrariwise sequential manner, opposite the predetermined sequential manner. In this manner, each band is sequentially re-applied to the user's head substantially similar to the as-presented, band carrying user's head prior to the on-boarding process.

Further, the re-application board may include alpha-numeric indicia sequentially identifying either (a) an uppermost line on the board to the lowermost line on the board or (b) the centermost line on the board to the outermost line on the board.

During the re-application process rather than using the contrariwise sequence, the board-mounted bands may be removed from the board in the predetermined board-mounted sequential manner, and then placed on the user's head in that same predetermined sequential manner. In this manner, each band is sequentially re-applied to the user's head substantially similar to the as-presented, band carrying user's head prior to the on-boarding process.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention will be apparent from the following detailed description when taken in conjunction with the accompanying drawings.

FIGS. 7A-7F diagrammatically illustrate different sequential hair extension removal (from the user's head) and on-boarding processes for a linear re-application board.

FIGS. 8A-8B diagrammatically illustrate how the different sequential on-boarding processes shown in FIGS. 7A-7F and be converted to curvilinear re-application boards.

DETAILED DESCRIPTION OF THE PREFERRED EMBODIMENTS

Figure 1:
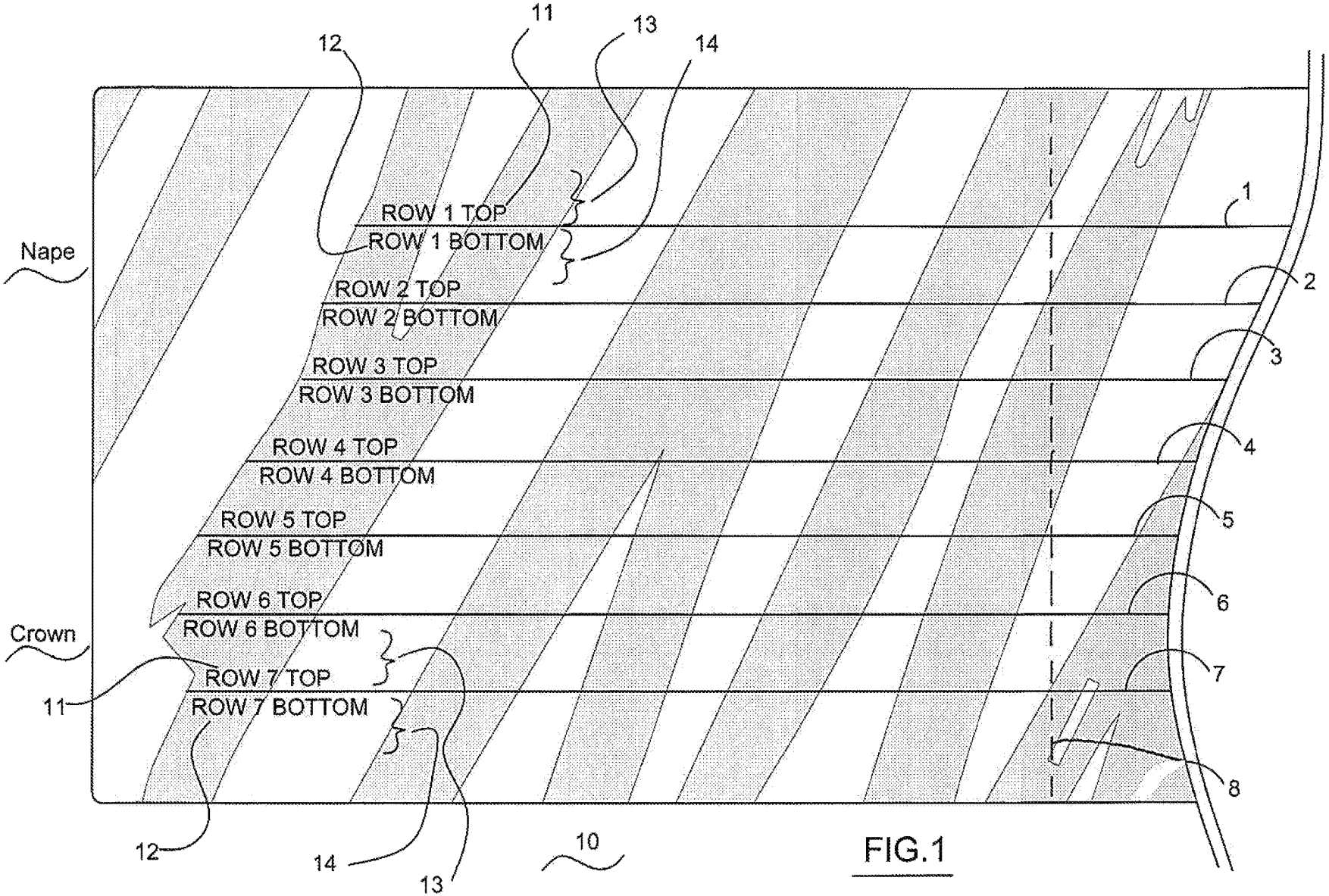
FIG. 1 is a partial view of a removal and re-application board, the right-side portion of the board being truncated, and the board marked with linear spaced apart lines forming a columnar matrix used to map hair extension bands.

Referring now to the drawings, the invention will be described in more detail. It is important to note that the embodiments of the invention described below are only examples of the several advantageous uses of the innovative teachings described herein. In general, statements made in the specification of the present application do not necessarily limit any of the various claimed inventions. Moreover, some statements may apply to some inventive features but not to others. In general, unless otherwise indicated, singular elements may be in the plural and vice versa with no loss of generality.

As used herein, the term "stylist" refers to the individual that removes or applies the hair extensions to someone's head. The term "user" or "wearer" refers to the individual that is having the extensions removed or re-applied to their head. The "user" may also be considered the "stylist" herein when the user is removing or applying their own extensions themselves. The term "board" refers to the re-application board for tape-in hair extensions.

FIG. 1 illustrates one embodiment of the present invention as re-application board 10 for hair extensions. The term "removal and re-application board" refers a board used in connection with the removal of tape-in hair bands from the user's head wherein the hair extension bands are thereafter mounted onto the board and, is a predefined manner these bands are withdrawn or dismounted from the board and then re-applied to the user's head. The board 10 carries indicia as an integral means for conveying the order in which to remove hair band extensions and thereafter re-apply tape-in hair extensions to the user's head in a manner to substantially replicate the placement of the hair bands on the user's head at substantially the same locations as where the hair bands were removed from the user's head. The board 10 contains 3 to 9 serially spaced apart lines 1-7 forming a columnar matrix on the board. Board 10 has linear lines running horizontally on the board and a number of parallely spaced apart linear lines, thereby forming the columnar matrix. As discussed later, the lines need not be linear. The board 10 may be made of many different materials, such as, plastic, acrylic, stainless steel, metal, foam, paper, cardboard and any other known material that would support the board's 10 intended purpose. With a foam board, the board forms a pin cushion. The board 10 can be rectangular shaped (shown in FIG. 1), curvilinear, shaped in an arc or half circle (shown in FIG. 6), a circle (shown in FIG. 5) or the profile of a head from the side and/or back. The re-application board 10 may be shaped in a variety of ways while still maintaining the desired functionality, namely, indicia permitting the stylist to remove hair extension bands from the head of a user (or the user to do the same by herself) one-by-one, and thereafter mount the extension bands on the board in a predetermined on-boarding sequence, using the indicia to map board location to "as presented hair band location" on the user's head, then remove or withdraw the bands from the board and re-apply the bands to the user's head in order to substantially replicate the position of the hair extensions on said user's head prior to said on-boarding process (the "as presented" user's head, prior to removal of the bands).

One of the several significant features of board 10 is indicia marking the serially spaced apart lines 1-7 and the spacing above 13 and below 14 each indicia line. The spacing between the lines needs to be adequate enough so as to fit an adhesive band of a tape-in hair extension. If pin-mounting is employed, the space between serial lines forming the columnar matrix should be adequate to pin mount the band on the board. Since the precise dimensions of a hair band holding a plurality of hair extension strands varies dependent upon manufacturer specifications, the spacing between lines 1-7 is based upon the size of the band. Therefore, there must be a lower 14 and an upper space 13, respectively below and above the respective line, for adhering or pin-mounting hair extension band thereat. Indicia 11, 12 is another of the several features of the invention because indicia 11, 12 relays information to the stylist or the user regarding an order of band removal from the user's head and the order of re-application of the bands to the user's head to substantially replicate the as-presented user's hair-plus-extension look.

Figure 2:
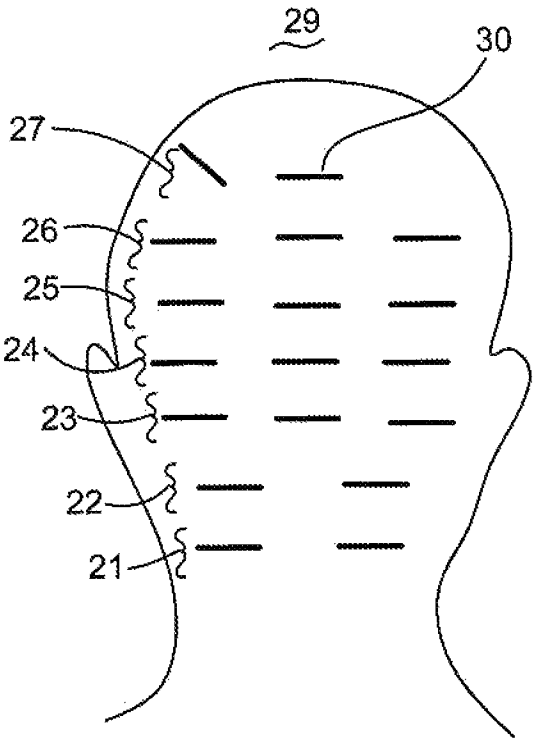
FIG. 2 is a back view of a user's head showing the placement of hair extensions.

In FIG. 1, board 10 includes seven serially spaced apart lines 1-7. The board 10 is rectangular. The serially spaced apart lines 1-7 are parallel, linear, horizontal, lines and each line is vertically spaced apart from the adjacent line. Each serially spaced apart line 1-7 is labeled and numbered with indicia on the left side of the serially spaced apart lines 1-7. The serially spaced apart line 1, closest to the top edge of the board 10, is labeled as Row 1. Each serially spaced apart line 2-7 after Row 1 is labeled and numbered sequentially toward the last labeled and numbered serially spaced apart line 7 labeled as Row 7 at a bottom edge of the board 10. The last serially spaced apart line 7 is labeled as Row 7. In FIG. 2, these serially spaced apart lines 1-7 correspond to the horizontal rows 21-27 of hair extensions 30 in a user's head 29.

Figure 4:
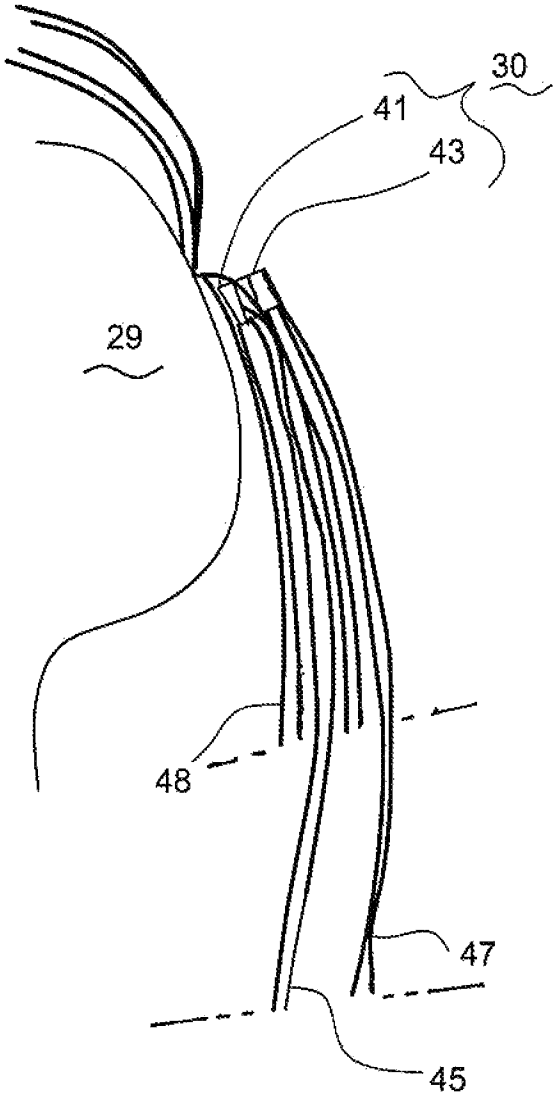
FIG. 4 is a diagrammatic illustration showing stacked tape-in hair extensions attached to a user's hair, however the re-application board may be employed with non-stacked hair extension bands (that is, a single hair band with one adhesive surface).

There are indications or indicia above and below each of the serially spaced apart lines 1-7 on re-application board 10. See FIG. 1. The indication—indicia above each serially spaced apart line 1-7 states that it is a top row 11. For example, the serially spaced apart line 1 includes the indication above the line 1 that says "Row 1 top" 11. The indication below each serially spaced apart line 1-7 states that it is a "bottom row", such as bottom row 12. For example, serial line 1 includes the indication below line 1 that says "Row 1 bottom" 12. The upper space 13 and lower space 14 adjacent each serially spaced apart line 1-7 display to the user-stylist areas for hair band attachment of multiple hair extensions 30. In FIG. 4, the tape-in extensions 30 are typically applied in stacked, top and bottom pairs 41 and 43 with an adhesive side of a bottom band facing a corresponding bottom face of a top band and each band pair is secured to the user's hair 48 by the user's hair 48 being sandwiched between the bands 41 and 43 (bands 41 and 43 forming a stacked pair). The user's hair 48 may also be secured to outer side of the sandwiched extensions 41 and 43 when double-sided tape is used. This pair 41 and 43 make up the top and bottom extension that are put on the board in the indicia marked "top" and "bottom" spaces 13 and 14 respectively. Alternative to the stacked hair bands shown in FIG. 4, the hair extension bands may be a tape band having only one side carrying adhesive. See U.S. Pat. No. 8,434,500, entitled Hair Band, which describes the one-adhesive-sided hair extension band. The one-adhesive-sided hair band is placed either above or below a particular line on the board.

In FIG. 4, to apply a pair of hair extensions 30 to the user's hair 48, the stylist removes the backing from a tape-in hair extension 41 and tape-in hair extension 41 is placed under the one quarter section of hair 48 with the adhesive side up (a bottom hair extension band). The user's hair 48 is gently rubbed onto the adhesive stip using a comb. Next, a second tape-in extension band 43 (a top band), with the backing removed, is placed directly on top of the first, bottom extension band 41. The extensions 41 and 43 are then pinched together forming a sandwich around the user's hair 48. In FIG. 4, the pair of hair extensions 30, add hair length 45 and 47 to the user's hair 48. The paired or stacked hair extensions 41 and 43 are referred to herein as hair extension 30. However, hair extension 30 is actually comprised of a pair of stacked top and bottom hair extension bands 41 and 43 working together. This pattern is repeated as the extensions are added upward to the crown of the head. In some cases, especially near the crown of the head, the stylist may use only one extension 41 by itself. This application process can be applied to new or re-applied extensions. As is described below, this general process is applicable when using the re-application board 10 during a hair band re-application process. The re-application process (conducted after the on-boarding process) generally includes removing the hair band from the band-loaded board, and then re-applying each band onto the user's head, preferably replicating the band location on the user's head at substantially the same location as the band was removed form the user's head, prior to the on-boarding process. In this manner, the cut extension hairs on a particular band fall at the same location as the cut extension hairs when the bands were first attached to the user's head.

Referring back to FIG. 1, during removal, the hair extensions 30 are attachable to the board 10 by the adhesive strip on the hair extension 30 (either one of the stacked bands or the one-side-adhesive bands). In FIG. 4, hair extension 30 is made up of a pair of hair extensions 41 and 43 sandwiched together. Therefore, the hair extension band pair 41 and 43 must be separated from each other and from a user's hair 48. After removal of band 41 from the user's hair, the stylist adheres the bottom band 41 of the first pair of hair extension bands onto the re-application board 10 on serially spaced apart line 7 labeled as "Row 7 bottom" 12. This bottom extension band 41 will be placed in lower space 14 below the serially spaced apart line 7. After removal of band 43 from the user's head, the stylist adheres the top 43 of the first pair of hair extension bands onto the re-application board 10 on serially line 7 labeled as "Row 7 top" 11. This top extension 43 is placed in upper space 13 above the serial line 7. It should be noted that both bands 41, 43 can be removed from the user's head at substantially the same time and then the bottom band 41 is mounted on board 10 below line 7 and then the top band 43 is mounted on board 10 above line 7. Accordingly, for each serially spaced apart line 1-7, there will be about two to seven pairs of extensions 30, and each pair will be split such that the top extension 43 is placed in the upper space 13 above the serially spaced apart line 1-7 and the bottom extension 41 is placed in the lower space 14 below the serially spaced apart line 1-7.

Since the stylist may mount 2-7 stacked bands below and above line 7, the horizontal linear line 7 may be a broken horizontal line (horizontal indicia comprised of several large dashed lines). Therefore, given the serially spaced apart linear lines in FIG. 1, these serially spaced apart linear lines as a group form a columnar matrix, since the stylists mounts the hair bands in a certain sequence on each particular line and also spaces the hair bands along the length of the line. When mounted on the board, the hair bands form a columnar matrix of mounted hair bands.

One of the several important aspects of the present invention is that the indicia carrying board 10 is a visual tool for the stylist to (a) remove hair bands from the user's head in a certain removal sequence, (b) place the hair bands on the board in a predetermined sequence, (c) the labeled board position enabling the stylist to remember the sequence of hair band removal, and (d) enabling the stylist to dismount the hair bands in a contrariwise sequential manner, opposite the initial predetermined sequence, thereby replicating, in a substantially similar manner, the placement of the hair bands on the user's heads at more or less the same position as the original placement of the hair band on the user's head before any use of board 10 (sometimes referred to as hair extensions presented on the user's head prior to said on-boarding process). Since the removal of bands from the user's head is done is a predetermined removal sequence and then the removed bands are placed on the board in the predetermined sequence, indicia on the board "Row 7 Top"; "Row 7 Bottom", etc. assists the stylist and prompts the stylist to remove bands form the user's head in that predetermined sequence, using the indicia and the board lines as prompts. Further, the band-loaded board prompts the user to dismount the bands in the opposite sequence, sometimes called herein the contrariwise predetermined sequence. Other sequences of band removal and board mounting are discussed in connection with FIGS. 7A-7F and 8A-8B. Not only can the predetermined sequences be altered as needed or as convenient to the stylist or the cut and shape of the as-presented, extension carrying head of the user, but the board shape can be changed to assist in this prompted removal and board-mounting process.

The re-application board 10 for hair extensions carries with it the integral means for conveying the order in which to remove and re-apply tape-in hair extensions 30, namely, the indicia 11, 12 and serially spaced apart lines 1-7 forming upper and lower spaces 13 and 14. The board 10 also keeps the extensions 30 organized and allows for ease of re-application of the extensions 30 in the correct location on the user's head 29. The bands, removably mounted on the board in the manner described above forms an organized platform for the multitude of hair strand falling from each hair band. It is the multitude of hair extension strands falling freely down from each hair band that interfere with the process of mounting additional hair bands on the board that causes a problem for the stylist-user. The indicia and the spaced apart lines provide removal information to sequentially mount each band at a single board location. In order to re-use and re-apply hair extensions 30, the re-application of the hair extension 30 in the same location as it was originally placed on the user's head 29 is important, as it helps the hair extension 30 flow and blend with the original hair 48. Typically, the hair on band extensions 30 have been cut with the hair during the original placement. Therefore, the length is specific to that location on the user's head 29.

Figure 3:
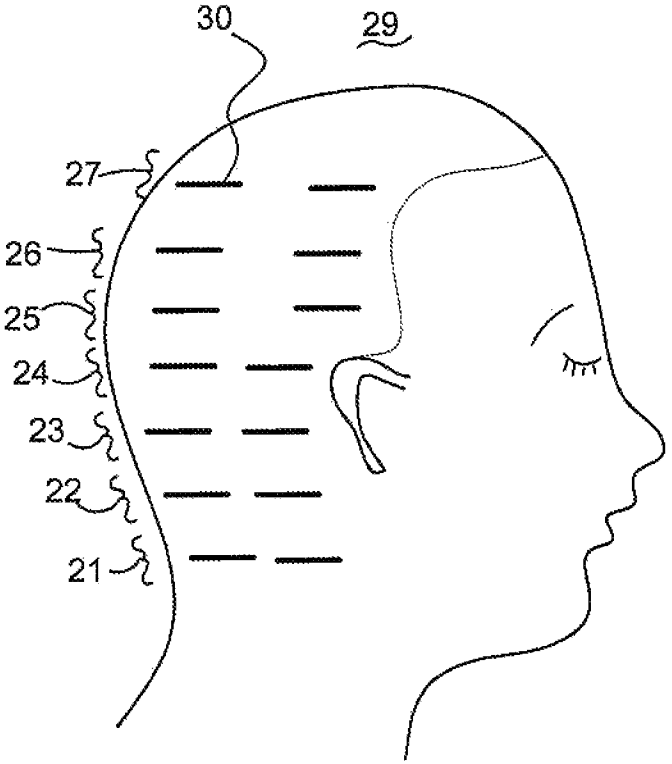
FIG. 3 is a side view of a user's head showing the placement of hair extensions.

FIG. 2 is a back view of a head 29 showing the placement of extensions 30. FIG. 3 is a side view of a head 29 showing the placement of extensions 30. The serially spaced apart lines 1-7 on re-application board 10 of FIG. 1 correspond to the horizontal rows 21-27 of hair extensions 30 in a user's head 29. The serially spaced apart lines 1-7 correspond to the reverse order of horizontal rows 21-27 on the user's head 29 such that during removal of the extensions the stylist begins at the crown of the user's head 29 in row 27, but attaches the removed hair extensions to serially spaced apart line 7 labeled as "Row 7" which is at the bottom of the removal and re-application board 10. Accordingly, the first serially spaced apart line 1 corresponds to hair extensions in row 21. Serially spaced apart line 2 corresponds to hair extensions in row 22. Serially spaced apart line 3 corresponds to hair extensions in row 23. Serially spaced apart line 4 corresponds to hair extensions in row 24. Serially spaced apart line 5 corresponds to hair extensions in row 25. Serially spaced apart line 6 corresponds to hair extensions in row 26. Serially spaced apart line 7 corresponds to hair extensions in row 27. It is understood that not all serially spaced apart lines 1-7 will always need to be used, because the number of hair extensions 30 used depends upon the wearer and the desired look. If the horizontal linear lines are serially spaced apart horizontal dashed lines, not all of the horizontally spaced apart dashes may be used by the stylist, again dependent upon the as-presented, extension carrying head of the user (prior to band removal and board mounting). Even if less than seven rows of extensions are used in the wearer's hair, the re-application board 10 can be used to hold the extensions 30. The stylist would just skip the serially spaced apart lines 1-7 that were not filled with extensions 30. Likewise, if only one extension 30 is used instead of a pair of extensions 41 and 43, the stylist would place the one extension on the space above 13 the line and skip the space below 14 the line.

Referring to FIGS. 1, 2 and 3 a process for removing, storing and re-applying hair extensions using the board 10 is discussed herein. The stylist removing the tape-in hair extensions starts by removing the top row 27 of extensions 30 from the wearer's head 29. The sides of the top row are removed first. The stylist begins at the crown of the wearer's head with the first pair of extensions. As discussed above, hair extensions 30 are most often made up of a pair of hair extensions 41 and 43 sandwiched together as shown in FIG. 4. Therefore, the hair extensions pair 41 and 43 must be separated from each other and from a user's hair 48 during removal. After the pair of extensions are separated from each other, the stylist adheres the top 43 of the first pair of hair extensions onto the removal and re-application board 10 on serially spaced apart line 7 labeled as "Row 7 top." This top extension 43 is placed in space 13 above the serially spaced apart line 7. Then the stylist adheres the bottom 41 of the first pair of hair extensions onto the removal and re-application board 10 on serially spaced apart line 7 labeled as "Row 7 bottom." This bottom extension 41 will be placed in space 14 below the serially spaced apart line 7. The stylist proceeds with removing hair extensions along the row 27 and placing the separated pairs above and below serially spaced apart line 7 adjacent to the prior extensions. Next the stylist removes the extensions 30 from row 26 and places them in serially spaced apart line 6 on the removal and re-application board 10 in the same fashion, separating the pairs and adhering the top extensions in the space above 13 the serially spaced apart line 6 and the bottom extensions in the space below 14 serially spaced apart line 6. The stylist continues to remove the next row 25 of hair extensions 30 proceeding in rows down the head 29 toward the nape of the neck and adhering the hair extensions 30 to the removal and re-application board 10 on the designated serially spaced apart line 1-7 as they are removed. As the stylist works down the head 29 removing extensions, the stylist will fill the board 10 with extensions from the bottom to the top of the board 10.

The removal and re-application board 10 may be folded in half at the mid-point region 8, which can be designated with dotted lines or other marks. The removal and re-application board 10 will be folded at the mid-point region 8 onto itself which will put the hair extensions 30 that have been adhered to the board 10 on the inside and thus protect them. This will allow the extensions 30 to be transported, while maintaining them without tangling. This board 10 also keeps the extensions in the exact order that they should be applied and the exact location of their placement on the user's head.

As shown in FIGS. 1-4, the re-application board 10 assists the stylist in re-applying the hair extensions 30 to the correct location on the user's head 29. The stylist starts by applying the extensions found at the top of the re-application board 10. The stylist begins at the uppermost serially spaced apart line 1 labeled as "Row 1 bottom." "Row 1 bottom" is the space below 14 serially spaced apart line 1. The bottom extension 41 adhered to "Row 1 bottom" is removed from the board 10. Sometimes a new adhesive band or backing is applied to the extension 30. The extension 41 is then applied to the wearer's hair in row 21 near the nape of the neck. Next, the stylist removes the top extension 43 adhered to "Row 1 top," applies a new adhesive band or backing to the extension 43, and applies the extension the user's hair forming the pair of a top and bottom extension sandwiching the user's hair, as shown in FIG. 4. The stylist continues to repeat this pattern, applying the bottom extension from space 14 then the top extension from space 13, down the serially spaced apart line 1 until all pairs of extensions 30 have been placed in row 21. The stylist then begins to apply the extensions from serially spaced apart line 2 to row 22 of the user's head 29. The stylist works down the serially spaced apart line of extensions from left to right, applying the bottom extension then the top extension. The stylist continues to re-apply the next row 23 of hair extensions 30 proceeding in rows up the head 29 toward the crown of the head 29 and removing the hair extensions 30 from the removal and re-application board 10 on the designated serially spaced apart line 1-7 as they are re-applied to the user's head 29. As the stylist works up the head 29 re-applying extensions, the stylist is removing extensions from the top of the board 10 working toward the bottom of the board 10. The re-application is complete once the stylist has reached Row 7 and all of the extensions have been reapplied to the user's hair.

Different mounts may be used for mounting the band on the board. Bands with adhesive are discussed above wherein the band-adhesive is used to mount the band on the board. However, if the board formed a pin-cushion, or had a pin-penetration surface, the hair bands can be mounted by pins on the board.

Figure 5:
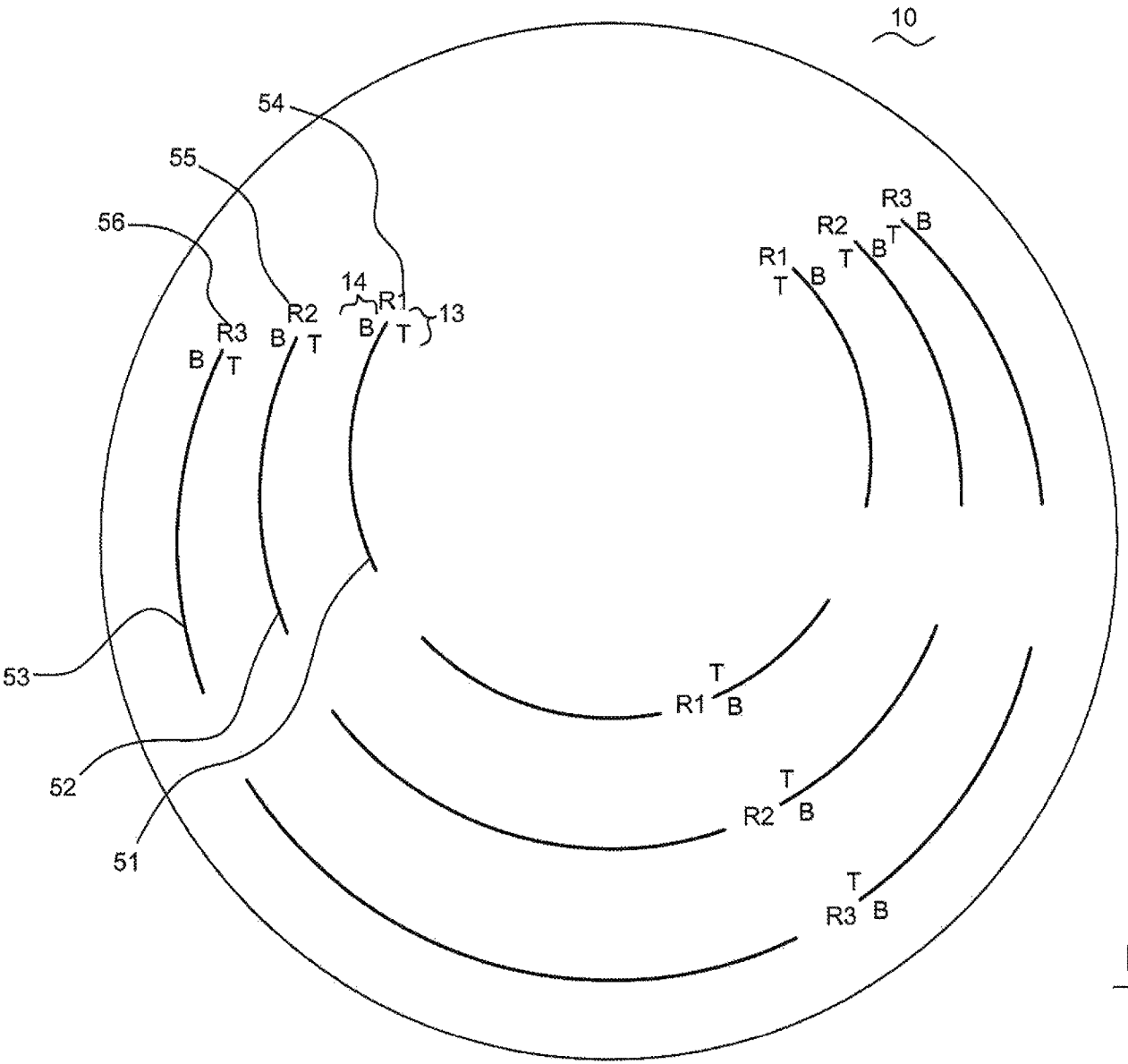
FIG. 5 is a front view of a re-application board shaped as a circle.
Figure 6:
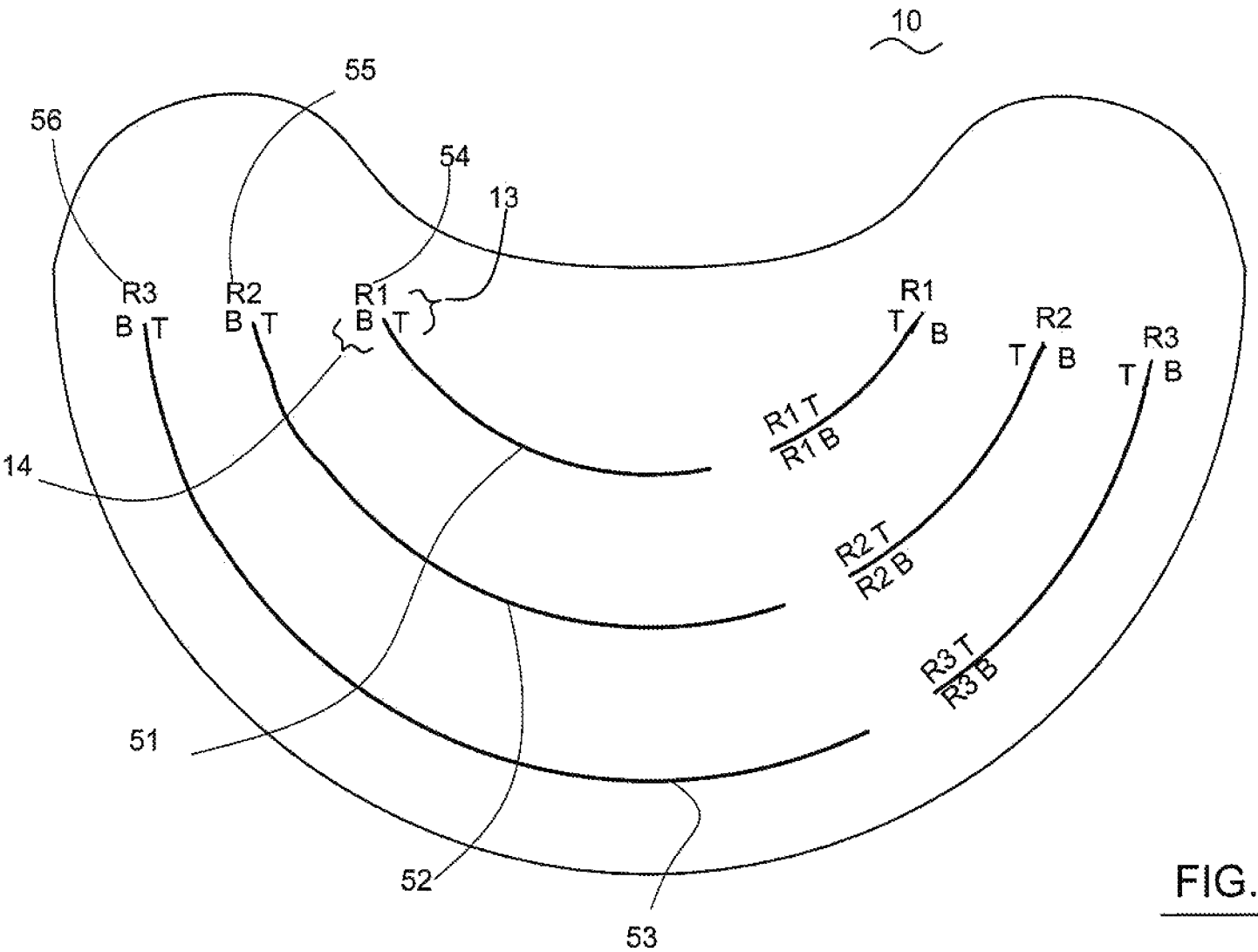
FIG. 6 is a front view of a re-application board shaped as a semi-circle shape.

FIG. 5 is a front view of a re-application board in the shape of a circle 50 and FIG. 6 is a front view of a re-application board shaped in a semi-circle shape. Both of these boards 10 include serially spaced apart curvilinear parallel lines 51, 52, 53 on the board 10. Each serially spaced apart curvilinear parallel line is radially spaced apart from the other. Each serially spaced apart curvilinear parallel line 51, 52, 53 is labeled and numbered with indicia 54, 55, 56 near the respective line. The serially spaced apart curvilinear line 51 closest to the centermost portion of the board 10, is labeled as "R1" 54. "R1" is the radially inward curvilinear line and refers to row 1 discussed above. R3 is the radially outermost curvilinear line and R2 is an intermediate curvilinear line. If 4 curvilinear lines were used, one intermediate line would be the intermediate inner arcuate segment and the other intermediate curvilinear line would be the outer intermediate arcuate segment (see FIG. 8A, 8B). Each serially spaced apart line 52, 53 outward of R3 is labeled and numbered sequentially toward the last labeled and numbered serially spaced apart curvilinear parallel line 56, labeled as R3 at the outermost edge of the board 10. In the embodiment shown in FIGS. 5 and 6, the last serially spaced apart curvilinear parallel line 53 is labeled as "R3" as curvilinear line 56. These serially spaced apart curvilinear lines 51, 52, 53 correspond to the horizontal rows 21-27 of hair extensions in a user's head. The boards 10 in FIGS. 5 and 6 are shown with three lines, however, the boards 10 can contain at least 4 but no more than 9 serially spaced apart curvilinear parallel lines 51-53.

It should be noted that the shape of the board also assists and prompts the stylists to remove bands from the as-presented, band carrying user head. FIG. 1 is a rectilinear board. FIG. 5 is a circular board. FIG. 6 is similar to an artist's paint carrying board. However, the board may be shaped as shown in FIGS. 2 and 3. In the case of head-shaped boards, row indicia would follow the pattern discussed above.

Not only can the shape of the board 10 can be used as a tool to prompt the stylist to remove hair bands in a certain sequence onto a columnar matrix (see spaced linear and curvilinear matrices on FIGS. 1, 5, 6), but the indicia-prompting sequence (the predetermined sequence of (i) band removal from head, (ii) band mounting on board (on-boarding), (iii) band removal from board, and (iv) band re-application on user's head) displayed on the board can be changed as desired by the hair band manufacturer or the stylist.

FIGS. 7A-7F diagrammatically illustrate different sequential hair extension removal (from the user's head) and on-boarding processes for a linear re-application board. FIGS. 8A-8B diagrammatically illustrate how the different sequential on-boarding processes shown in FIGS. 7A-7F and be converted to curvilinear re-application boards.

FIG. 7A (Process A) graphically illustrates the predetermined sequence described above in connection with FIG. 1, i.e., start with the crown, mount on the bottommost row 4, and from left to right mount the then-removed bands onto the board. The FIG. 7 graphic shows 7 bands on the crown, bands 8 to 14 on row 3, bands 15-21 on row 2 and bands 22-28 on row 1 (removed from the user's nape). FIG. 7B (Process B) shows the reverse when band 1 is removed from the nape and is placed on the left-side of board row 1. FIG. 7C (Process C) shows a diagonal predetermined sequence when band 1 is removed from the nape and placed on board row 1, band 2 is removed from an intermediate head location and placed on board row 2 at column 2, band 3 removed from an intermediate head location and placed on board row 3 at column 3, etc. FIG. 7D shows a different or reverse diagonal predetermined sequence when band 1 is removed from the crown and placed on board row 4, band 2 is removed from an intermediate head location and placed on board row 2 at column 2, band 3 removed from an intermediate head location and placed on board row 3 at column 3, etc. FIG. 7E graphically shows a right-to-left predetermined sequence, similar to FIG. 7A but proceeding right to left (band 1 at the crown removed and mounted on board place row 4, column 7). FIG. 7F graphically shows a right-to-left predetermined sequence, similar to FIG. 7D but proceeding nape to crown, right to left, for band 1 at row 1, column 7 to band 2 at row 2, column 6.

FIGS. 8A and 8B graphically show the predetermined sequences for curvilinear spaced apart columnar matrix. FIG. 8A is similar to the left-to-right, nape to crown predetermined sequence as shown in FIG. 7A and described in detail above. FIG. 8B shows a diagonal predetermined sequence.

Therefore, there are many predetermined sequences and board shapes to assist the stylist to remove hair bands in a certain sequence, place those bands at predetermined locations on the board, then withdraw or dismount the bands from the board and re-apply the bands to the user's head. The board in a preferred embodiment is a flat plate.

During the re-application process rather than using the contrariwise re-application-to-head sequence, the board-mounted bands may be removed from the board in the predetermined board-mounted sequential manner, and then placed on the user's head in that same predetermined sequential manner. In this manner, each band is sequentially re-applied to the user's head substantially similar to the as-presented, band carrying user's head prior to the on-boarding process.

While the preferred embodiment(s) of the invention has been described using specific terms, such description is for illustrative purposes only, and it is to be understood that changes and variations may be made without departing from the spirit or scope of the following claims. The claims appended hereto are meant to cover modifications and changes within the scope and spirit of the present invention.

What is claimed:

1. A process for removing, storing and re-applying tape-in hair extensions comprising:

providing a removal and re-application board, wherein the removal and re-application board has at least 3 serially spaced apart lines;

(a) removing tape-in hair extensions from a user's head beginning at a crown of an individual's head with a first pair of hair extensions;

(b) separating the first pair of hair extensions from each other and from a user's hair, the pair of hair extensions formed by a top hair extension and a bottom hair extension;

(c) adhering said top hair extension of the first pair of hair extensions onto said removal and re-application board on a space above a serially spaced apart line, the serially spaced apart line being the lowest of the serially spaced apart lines on the board;

(d) adhering said bottom hair extension from the first pair of hair extensions onto the removal and re-application board in a space below the serially spaced apart line containing the top of the first pair of hair extensions;

(e) removing a second pair of hair extensions from the user's head that was adjacent to the first pair of hair extensions and in a same horizontal row on the user's head;

(f) separating the second pair of hair extensions from each other and from the user's hair;

(g) adhering a top of the second pair of extensions onto the removal and re-application board in the space above the serially spaced apart line, adjacent to the top of the first pair;

(h) adhering a bottom from the second pair of extensions onto the removal and re-application board in the space below the serially spaced apart line, adjacent to the bottom of the first pair;

(i) continuing to remove the remaining pairs of hair extensions in the same horizontal row on the user's head and placing them sequentially in the serially spaced apart line adjacent the first and second pair of hair extensions; and (j) continuing to remove the next row of hair extensions under the first row proceeding in rows down the head toward the nape of the neck and adhering the hair extensions to the removal and re-application board on the designated serially spaced apart line proceeding in a direction from the bottom of removal and re-application board to the top of the board.

2. The process for removing, storing and re-applying tape-in hair extensions of claim 1, further comprising the steps of:

folding the board in half at a fold line, wherein the hair extensions are adhered to the inside of the board, so that the hair extensions maybe stored.

3. The process for removing, storing and re-applying tape-in hair extensions of claim 1, further comprising the steps of:

(a) re-applying tape-in hair extensions to a user's head beginning at the nape of an individual's neck with a first pair of hair extensions;

(b) removing said bottom of a first pair of hair extensions from said removal and re-application board, wherein the bottom of the first pair of extensions is adhered on a space below the serially spaced apart line and wherein the serially spaced apart line being the uppermost serially spaced apart line on the board, adding additional adhesive backing to the hair extension, and adhering the bottom of the first pair of hair extensions to said user's head beginning in a row at the nape of the user's neck;

(c) removing said top of a first pair of hair extensions from the removal and re-application board in a space above the serially spaced apart line, adding additional adhesive backing to the hair extension, and adhering the top of the first pair of hair extensions on a top of the bottom of the first pair of hair extensions adhered to said user's hair, wherein the adhered hair extension is made up of the top and the bottom hair extensions forming the first pair of hair extensions adhered to the user's hair by sandwiching the user's hair between the two adhesive surfaces of the top and bottom of the first pair of hair extensions;

(d) re-applying a second pair of hair extensions from the board that was adjacent to the first pair of hair extensions and on a same serially spaced apart line on the board;

(e) continuing to re-apply the remaining pairs of hair extensions in the same serially spaced apart line from the board and placing them sequentially in the horizontal row on the user's head adjacent the first and second pair of hair extensions; and (f) continuing to re-apply the next serially spaced apart line of hair extensions below the proceeding serially spaced apart line removing the hair extensions from the removal and re-application board on the designated serially spaced apart line proceeding in a direction toward the bottom of the board and re-applying the extensions in rows up the head beginning at the nape of the neck and moving toward the crown of the head.

4. A process for removing, storing and re-applying tape-in hair extensions comprising:

providing a removal and re-application board, wherein the removal and re-application board has at least 3 serially spaced apart lines which may be linear or curvilinear lines;

(a) removing a first tape-in hair extension from a user's head beginning at a crown or a nape of an individual's head, said first tape-in hair extension being one of a plurality of hair extensions on said head;

(b) adhering said first hair extension onto said removal and re-application board;

(c) serially removing, one at a time, remaining hair extensions from the user's head first horizontally and then either (i) progressively downward to said nape of said user's head or (ii) progressively upward to said crown of said user's head;

(d) serially adhering, one at a time, respective ones of said remaining hair extensions onto the removal and re-application board, first horizontally along a respective linear or curvilinear line, and then either progressively downward or upward over the removal and re-application board;

(e) re-applying tape-in hair extensions to said user's head beginning either at the nape or the crown of said user's head by removing a mounted hair extension located either at a lowest position or a highest linear or curvilinear line from said removal and re-application board; and (f) serially, one at a time, removing respective ones of remaining mounted hair extensions first horizontally from either said highest or said lowest position linear or curvilinear line from said removal and re-application board and then progressively upward or downward over the removal and re-application board, and re-applying, one at a time, said respective ones of said remaining mounted hair extensions to said user's head from either said nape to said crown or said crown to said nape.

5. The process for removing, storing and re-applying tape-in hair extensions as claimed in claim 4 including storing said removal and re-application board intermediate steps (c) and (d).

* * * * *